US011272774B2

(12) United States Patent
Tan et al.

(10) Patent No.: US 11,272,774 B2
(45) **Date of Patent: *Mar. 15, 2022**

(54) MINIATURE, MULTIPLE ANGLE ACCESSIBLE, ULTRAVIOLET NAIL GEL CURING LAMP AND METHOD OF USE

(71) Applicant: Glam and Glits Nail Design, Inc., Bakersfield, CA (US)

(72) Inventors: Ana Katrina Tan, Bakersfield, CA (US); Khoa Duong, Bakersfield, CA (US)

(73) Assignee: Glam and Glits Nail Design, Inc., Bakersfield, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/093,510

(22) Filed: Nov. 9, 2020

(65) Prior Publication Data

US 2021/0112942 A1 Apr. 22, 2021

Related U.S. Application Data

(63) Continuation of application No. 16/894,688, filed on Jun. 5, 2020, now Pat. No. 10,827,815, which is a (Continued)

(51) Int. Cl.
*A45D 29/18* (2006.01)
*F26B 9/00* (2006.01)

(Continued)

(52) U.S. Cl.
CPC ..... *A45D 29/18* (2013.01); *A45D 29/22* (2013.01); *F26B 9/003* (2013.01); *A45D 2200/205* (2013.01); *F26B 3/28* (2013.01)

(58) Field of Classification Search
CPC ..... A45D 29/00; A45D 29/18; A45D 29/22; A45D 2200/20; A45D 44/00; G21K 5/00;

(Continued)

(56) References Cited

U.S. PATENT DOCUMENTS

D74,828 S 4/1928 De Vries
3,258,853 A 7/1966 Bradbury (Continued)

FOREIGN PATENT DOCUMENTS

CN 201375149 Y 12/2008
CN 20280042 U 3/2013

(Continued)

OTHER PUBLICATIONS

Snapshot of LED Nail Lamps/eBay; CND LED 3C Technology, Jun. 8, 2017—1 page.

(Continued)

*Primary Examiner* — David E Smith
(74) *Attorney, Agent, or Firm* — Lapple Ubell IP Law, LLP; Matthew C. Lapple

(57) ABSTRACT

Embodiments disclosed herein relate to a miniature, multiple-angle accessible nail gel curing lamp that minimizes the size of a light exposure area, while at the same time providing access to the light exposure area for a customer's hand, and both of technician's hands. This lamp is particularly useful for performing the "gel-press on" technique of applying artificial nails with a UV-curable nail gel. Some embodiments include a base, a riser extending generally upward from the base, and a lamp head extending generally horizontally from the riser, where the lamp head is operatively connectable to a power source and comprises an ultraviolet light emitting diode ("UV LED") configured to direct light emitted by the UV LED generally toward the base, thereby defining a light exposure area extending from the UV LED downward toward the base, and where an arc of access to the light exposure area is defined as an arc in a plane generally parallel to the UV LED and centered on the UV LED, so that the base, the riser and the lamp head are configured to allow unimpeded access of a user's hand to the (Continued)

light exposure area throughout the arc of access and where the arc of access is at least 180 degrees, and in some instances, at least 270 degrees.

16 Claims, 14 Drawing Sheets

Related U.S. Application Data continuation-in-part of application No. 16/857,094, filed on Apr. 23, 2020, which is a continuation of application No. 16/660,689, filed on Oct. 22, 2019.

(51) Int. Cl.
*A45D 29/22* (2006.01)
*F26B 3/28* (2006.01)

(58) Field of Classification Search
CPC ... G21K 5/02; G21K 5/04; G21K 5/08; B29C 35/08; F26B 9/003; F26B 3/28
See application file for complete search history.

(56) References Cited

U.S. PATENT DOCUMENTS

| | | | | |
|---|---|---|---|---|
| D277,323 | S | 1/1985 | Raicevic | |
| 4,731,541 | A | 3/1988 | Shoemaker | |
| D299,559 | S | 1/1989 | Wong | |
| 5,249,367 | A * | 10/1993 | Nafziger | A45D 29/18 34/202 |
| D381,464 | S | 7/1997 | Schaeffer et al. | |
| 6,518,583 | B1 * | 2/2003 | Hennig | A45D 29/00 250/504 R |
| D532,931 | S | 11/2006 | Chang | |
| D601,302 | S | 9/2009 | Chang | |
| D622,447 | S | 8/2010 | Hurman | |
| D641,105 | S | 7/2011 | Chan | |
| D643,576 | S | 8/2011 | Chan | |
| D661,021 | S | 5/2012 | Chang | |
| D662,259 | S | 6/2012 | Vu et al. | |
| D664,299 | S | 7/2012 | Ishida | |
| D669,154 | S | 10/2012 | Choi | |
| D672,091 | S | 12/2012 | Dyson et al. | |
| 8,466,442 | B2 | 6/2013 | Horvath et al. | |
| D686,369 | S | 7/2013 | Horvath et al. | |
| 8,534,299 | B2 | 9/2013 | Huynh | |
| D692,617 | S | 10/2013 | Halle | |
| 8,561,619 | B1 | 10/2013 | Han | |
| D701,296 | S | 3/2014 | Engelhardt | |
| D703,380 | S | 4/2014 | Lee | |
| 8,696,161 | B2 | 4/2014 | Pan et al. | |
| D704,888 | S | 5/2014 | Robert | |
| 8,739,431 | B2 | 6/2014 | Cheng | |
| D715,494 | S | 10/2014 | Kim | |
| 8,993,982 | B2 | 3/2015 | Barnard | |
| 8,993,983 | B2 | 3/2015 | Li et al. | |
| D734,548 | S | 7/2015 | Dadon | |
| D742,591 | S | 11/2015 | Takiguchi et al. | |
| D751,761 | S | 3/2016 | Jih | |
| D755,442 | S | 5/2016 | Jih | |
| D765,314 | S | 8/2016 | Loibl | |
| D769,530 | S | 10/2016 | Lin | |
| D785,870 | S | 5/2017 | Dadon | |
| D805,692 | S | 12/2017 | Cheng | |
| D811,010 | S | 2/2018 | Tan et al. | |
| 10,117,494 | B1 * | 11/2018 | Luu | A45D 29/00 |
| D844,472 | S | 4/2019 | Van Wijngaarden | |
| 10,448,723 | B1 | 10/2019 | Coefield | |
| D894,658 | S | 9/2020 | Davenport | |
| D900,396 | S | 10/2020 | Zhang | |
| 10,827,815 | B1 * | 11/2020 | Tan | A45D 29/18 |
| D917,785 | S | 4/2021 | Tan et al. | |
| 2006/0260628 | A1 * | 11/2006 | Chan | A45D 29/00 132/73 |
| 2008/0257272 | A1 | 10/2008 | Bolda | |
| 2011/0277338 | A1 | 11/2011 | Li et al. | |
| 2012/0060757 | A1 | 3/2012 | Li et al. | |
| 2013/0063922 | A1 | 3/2013 | La Porte et al. | |
| 2013/0134447 | A1 | 5/2013 | Pan et al. | |
| 2013/0161531 | A1 * | 6/2013 | Haile | A45D 29/00 250/455.11 |
| 2013/0313445 | A1 | 11/2013 | Watson | |
| 2014/0153245 | A1 | 6/2014 | Horvath | |
| 2014/0212304 | A1 | 7/2014 | Michael | |
| 2014/0346372 | A1 * | 11/2014 | Vu | A45D 29/001 250/492.1 |
| 2015/0082654 | A1 * | 3/2015 | Jaegal | A45D 29/00 34/275 |
| 2016/0273833 | A1 | 9/2016 | Haile et al. | |
| 2016/0353856 | A1 | 12/2016 | Horvath | |
| 2017/0135173 | A1 | 5/2017 | Huang | |
| 2019/0038792 | A1 | 2/2019 | Kreiner et al. | |
| 2019/0307223 | A1 * | 10/2019 | Coefield | A45D 29/00 |
| 2021/0112941 | A1 | 4/2021 | Tan et al. | |

FOREIGN PATENT DOCUMENTS

| | | | | |
|---|---|---|---|---|
| CN | 202842705 | U | | 4/2013 |
| CN | 203152867 | U | | 8/2013 |
| CN | 104116305 | A | | 7/2014 |
| CN | 203986624 | U | * | 12/2014 |
| CN | 204070986 | U | | 1/2015 |
| CN | 205456858 | U | | 8/2016 |
| CN | 206390514 | U | | 8/2017 |
| DE | 2161330 | A1 | | 6/1973 |
| DE | 102004046941 | A1 | | 3/2006 |
| EP | 1503387 | A1 | | 2/2005 |
| JP | 3151698 | U | | 7/2009 |
| JP | 3206778 | U | | 10/2016 |
| KR | 2020120008827 | | | 9/2012 |
| KR | 10124153 | B1 | | 3/2013 |
| WO | 2014171441 | A1 | | 10/2014 |
| WO | 2015049845 | A1 | | 9/2015 |

OTHER PUBLICATIONS

Snapshot of Color Club Gel Mobile; Pro LED Lamp, Jun. 8, 2017—1 page.
Snapshot of LED Lamps Nail Dryers/eBay; Jun. 8, 2017—1 page.
Snapshot of NSI LED Lamp 36W, Jun. 8, 2017—1 page.
Snapshot of Light 110V OPI LED Lamp Professional Salon Nail Light Manicure Pedicure Gel C . . . —1 page.
Snapshot of OPI LED Light Studio 2016 Design; Sunshinenailsupply.com, Jun. 8, 2017—1 page.
Youtube Capture 'Suzie tries Apres Gel-X Nail System' at 9_51, Jan. 27, 2019—1 page.
LKE 12W Nail Dryer LED UV Lamp Micro USB Gel Varnish Curing Machine For Home Use Nail Art Tools Nail For Lamps, May 18, 2019—11 pages.
3W Mini USB UV Nail Gel Curing Lamp Light Nail Gel Polish Dryer 58×45×45mm Nail Art Machine LED UV Lamp, May 18, 2019—11 pages.
6W Portable Varnish Curing Machine Mini UV Nail Gel Curing Lamp Light Nail Gel Polish Dryer 75*21*11 mm Nail Art Machine, May 18, 2019—12 pages.
Nicole Diary 3W USB Mini Nail Dryer Portable UV LED Curing Lamp 30s Fast Drying Curing Light for Gel Polish, May 18, 2019—10 pages.
9W Mini LED lamp for drying nail curing lamp portable USB Cable home use Gel Nail tools painting nail lamp nail DIY Tools, May 18, 2019—13 pages.
LED UV Lamp 43×31×40mm Mini USB Portable Timing Nail Gel Curing Lamp Light Nail Lamp Nail Dryer Art Machine, May 18, 2019—12 pages.
Photographs of prior art device LED UV Lamp Model No. DR-619 and photographs of user manuals for prior art device LED UV Lamp Model No. DR-619—10 pages.
Photographs of prior art device LED UV Lamp Model No. DR-636 and photographs of user manuals for prior art device LED UV Lamp Model No. DR-636—12 pages.

(56) References Cited

OTHER PUBLICATIONS

Non-Final Office Action mailed by the Office dated Jul. 1, 2020 in the corresponding U.S. Appl. No. 16/894,688 in 14 pages.
C1/2W LED Entry Nail Lamp—Cosmex Co., Ltd., https://www.cosmex-tek.com/product/c1/, May 29, 2020—3 pages.
C4/6W LED Entry Nail Lamp—Cosmex Co., Ltd., https://www.cosmex-tek.com/product/c4/, May 29, 2020—3 pages.
Entry Nail Lamp—Cosmex Co., Ltd., https://www.cosmex-tek.com/product/entrylamp/, May 29, 2020—3 pages.
Cosmex Category_Y2017—27 pages.
How Touch Sensor Work, https://arrow.com/en/research-and-events/articles/how-tough-sensors-work, Jun. 2, 2020—5 pages.
TSItouch, manufacturer of touch screens and protective solutions—Infrared, https://tsitouch.com/products/infrared, Jun. 2, 2020—7 pages.
Touch switch—Wikipedia, "https://en.wikipedia.org/wiki/Touch-switch,"—Jun. 2, 2020—3 pages.

* cited by examiner

MINIATURE, MULTIPLE ANGLE ACCESSIBLE, ULTRAVIOLET NAIL GEL CURING LAMP AND METHOD OF USE

CROSS-REFERENCE TO RELATED APPLICATIONS

This application is a continuation-in-part of U.S. patent application Ser. No. 16/660,689; filed on Oct. 22, 2019, and Ser. No. 16/857,094; filed on Apr. 23, 2020, and a continuation of U.S. patent application Ser. No. 16/894,688; filed on Jun. 5, 2020, and issued as U.S. Pat. No. 10,827,815 on Nov. 10, 2020, all of which are incorporated by reference herein in their entirety.

FIELD OF THE DISCLOSURE

The present disclosure relates to UV-LED lamps for curing UV-curable nail gel.

BACKGROUND

Manicures and pedicures are considered by many to be an affordable luxury, and are widely enjoyed by both women and men. The manicure and pedicure industry in the United States, as of 2018, had approximately $8.3 billion in revenues. On average, in the United States during 2018, a deluxe manicure cost about $30 and a deluxe pedicure cost about $48. Thus, due to the relatively modest price of manicure and pedicure services, in view of their perceived position as a luxury service, there is a continuing need to develop products for the salon and spa industry that are cost-effective for the salon owner, efficient and easy to use, and time-saving for the technicians performing the services, all while being visually appealing, thereby enhancing and supporting the perception of manicures and pedicures as a luxury service.

One type of manicure service provided by many professional manicurists, sometimes referred to herein as technicians, is the application of a set of artificial fingernails over a customer's natural nails. The term "artificial fingernail" can include, but is not limited to, a full-cover nail intended to be applied to cover the entire surface of a user's natural nail and be longer than the natural nail, and a "nail extension," sometimes referred to as a "nail tip," which is intended to be applied to the edge of the user's natural nail so as to extend the length of the user's fingernail, without covering the natural nail bed.

An artificial nail may include a polymeric body in the shape of a desired nail or tip shape. The polymeric body can be made from a composition of Acrylonitrile-Butadiene-Styrene (ABS) plastic and a polycarbonate. The polymeric body can also be made from any plastic-like material suitable for extended contact with a human nail, such as ABS plastic, nylon, tenite acetate, vinyl acetate, polycarbonates, polyvinyl chloride, polyethylene terephthalate ("PET"), high-density polyethylene ("HDPE"), or acrylate polymers (which are sometimes referred to as "acrylic"). In certain embodiments, the polymeric artificial nail body is composed of a plastic-like material that will soften or dissolve in acetone. The polymeric artificial nails are also sometimes generally referred to herein by the industry terms of "gel nails" or "soft acrylic nails" or "soak-off gel nails" even when such artificial nails are not actually made of UV-curable gel, nor of acrylic. Artificial nails may be either pre-colored, or may be translucent/transparent, so that a technician can color the nail as desired by the customer, after the soft acrylic nail has be adhered to the customer's natural nail.

Artificial nails are very popular among consumers for their durability and greater length than most natural fingernails. Artificial nails can be adhered to natural nails by numerous techniques. One common technique is to affix the artificial nail to the natural nail bed with a liquid adhesive, such as, for example, a cyanoacrylate glue. However, such glues can cause allergic reactions, and can also make the artificial nails difficult to remove. Another technique is to provide an adhesive press-on tab, comprising a double-sided adhesive tape layer. This adhesive press-on tab may include removable layers to protect the adhesive and which are peeled off by the technician (or the home user) prior to application. Alternatively, the adhesive press-on tab may be pre-affixed to the underside of the acrylic nail, so that the technician (or home user) merely has to remove the removable layer, thereby exposing the adhesive, and then position and press the acrylic nail against the customer's natural nail. Such an approach is discussed in the prior art, such as in U.S. Pat. No. 8,561,619. However, such double-sided adhesive artificial nails often fall off when wet, or after being worn for only a few days.

One technique that is rapidly gaining popularity is to adhere an artificial nail to a natural nail by use of a clear gel polish, cured by exposure to UV light. In other words, the UV-curable gel polish is used as the bonding agent between the artificial nail and the customer's natural nail bed. Some embodiments of this approach are discussed extensively in U.S. Pat. No. 8,534,299, ("the '299 patent) which is hereby incorporated by reference herein. In accordance with industry usage, this technique is referred to herein variously as the "gel press-on nail" technique, or the "soft gel nail extension" technique. This approach may use the UV-curable gel nail bodies addressed in the '299 patent, or may use any other suitable artificial nail, in combination with the UV-curable gel as a bonding agent.

Use of the gel press-on nail technique requires use of a UV nail lamp or UV-LED nail lamp to cure the UV-curable gel. Typically, the nail technician will need to carefully prepare the client's natural nails. Then, the nail technician will apply a thin coating of UV-curable nail gel to the underside of an artificial nail. Next, the nail technician will hold the client's prepared finger with her left hand, and use her right hand to position the gel-coated artificial nail properly on the client's natural nail, so that the artificial nail is properly aligned with the client's cuticle. While holding the artificial nail in place, the nail technician must then press it down, so that any air bubbles between the natural nail and the artificial nail are squeezed out and so that the UV-curable gel is evenly distributed between the natural nail and the artificial nail. Finally, while maintaining the position of, and pressure on, the artificial nail, the nail technician must hold the nail under, and then activate the UV-LED nail lamp for a short period of time, for example ten seconds, so that the gel is at least partially cured, and the artificial nail is bonded to the natural nail. This short partial cure time is sometimes referred to in the industry and herein as a "flash cure." The nail technician must also ensure that, while pressing and holding the artificial nail, she does not block the UV light from reaching a part of the nail bed, and result in uncured gel. Alternatively, she must perform more than one flash cure, while she presses on different parts of the client's nail bed. Then, once artificial nails have been applied to all of the fingers on a client's hand, the whole hand may be inserted into a UV nail gel curing lamp for a longer time period to harden and finish curing of the UV gel bond.

UV nail lamps are well known, and come in a variety of sizes, configurations and wattages. Some, such as the Kiara Sky® BeyondPro lamp, sold by Applicant Glam and Glits Nail Design, Inc., and which is illustrated in U.S. Design Pat. No. D811,010, are configured to include a large number of UV LEDs. For example, the BeyondPro lamp has 14 UV-LEDs arranged along the roof and three walls of an interior treatment chamber, so as to expose the interior treatment chamber to UV light from multiple different angles. This serves to reduce the amount of time needed to fully cure a full set of UV-curable nails after they have been applied to a customer's hand. However, over-exposure to UV light can be harmful to the eyes or skin. To reduce UV light exposure to the customer's (and nail technician's) eyes and skin, most prior art lamps have openings to the treatment chamber that are of limited size. Further most also allow access to the treatment chamber in only one direction, e.g., they are closed on three sides. For example, the Kiara Sky® BeyondPro lamp has a front opening that is sized to allow a customer to insert either a hand, or a foot, into the lamp treatment area. However, the side walls and back wall of the lamp prevent UV light from escaping in these directions. As such, these side walls and back wall also generally prevent a technician from reaching into the lamp treatment area at the same time that a customer's hand or foot is positioned in the treatment area. Some lamps, such as the "Gelish 18G" by Gelish, and which is illustrated in U.S. Pat. No. 8,739,431, are configured to include a shield that slides into place to block as much UV light (and therefore access) as possible. This type of lamp configuration significantly reduces the usefulness of this type of lamp for the gel press-on nail technique, because the nail technician cannot hold the customer's finger, and position the artificial nail and hold it in place, while the customer's finger—and the UV-curable gel being used as the bonding agent—is exposed to UV light sufficient to partially cure the gel and bond the artificial nail in place. If the nail technician cannot position and hold the artificial nail, at the same time that it is exposed to UV light, then there is a significant risk that the artificial nail will fall off prior to bonding, or worse, that it will slip out of position and then be bonded to the customer's natural nail in a way that is misplaced or misaligned. Moreover, trying to use a full sized UV LED nail gel lamp—meant to cure the UV gel for a full set of fingernails—for flash curing a small amount of UV curable gel sufficient to bond an artificial fingernail to a natural nail—can result in an unhealthy and unwanted amount of UV light exposure for the customer and the nail technician.

Some efforts have been made in the prior art to address these drawbacks of full sized lamps and to tailor a flash cure lamp to the gel press-on technique. Yet, each known prior art miniature nail gel curing lamp suffers from additional problems and drawbacks.

For example, certain prior art miniature UV LED nail gel curing lamps have a "folding table" type configuration. These folding table type lamps have a generally flat body, about the size of a deck of playing cards, with between one to six UV LEDs on the underside of the body. The folding table type lamps also have two or more foldable legs that fold outward from the body, and which support the lamp on a flat surface, much like a folding table. This configuration of prior art lamp suffers from the problem of limited directional access. When in use, the extended legs typically block two directions of access to the light exposure area generated by the UV LEDs. Further, the extended legs are normally only between 40 mm and 68 mm in length. Thus, when this type of lamp is employed in the gel press-on technique, access to the light exposure area is quite limited, making it difficult for the nail technician to work. For example, the customer must put her finger under the lamp from a first direction, then the nail technician must reach under the light exposure area to position the nail gel and the artificial nail, from the second direction, on the other side of the lamp. The foldable legs on either side of the lamp tend to limit access to the light exposure area to only two directions. Still further, the flat body of the folding table type lamp blocks or partially blocks the nail technician's view of the customer's nail, making placement of the artificial nail difficult. Additionally, with some prior art lamps of this type, there is inadequate room to press down the artificial fingernail from the tip, while it is flash cured, so a nail technician must press down on the artificial nail at the nail bed, thus blocking UV light from reaching part of the nail gel. This requires either another flash cure, or results in uncured or partially cured nail gel, which could result in the artificial nail shifting or falling off prior to the final cure. Finally, when a home user attempts to use such a folding-table type lamp by herself to perform the gel press-on technique at home, it is extremely difficult, because in addition to the problems discussed above, the customer must be able to have a "third hand" or an assistant to turn on the lamp, because one hand is receiving an artificial fingernail, and one hand is positioning and holding the artificial fingernail, prior to activation of the lamp. Thus, it would be advantageous to be able to turn on the lamp while the home user has her hands in the lamp's light exposure area, or to have the lamp turn on as "hands free" when the home user positions her hands in the lamp's light exposure area.

Other prior art miniature UV LED nail gel curing lamps have an "arch" type configuration. These arch-type lamps have an integrated body and leg structure, which from the side looks like an arch. Arch-type lamps have a body holding one or more downwardly facing UV LEDs, and the body curves downwardly on two sides to form the two legs of an arch. The arch legs then can support the lamp on a flat surface. Again, when in use, the arch-type lamps suffer from all of the same problems as the folding-table type lamps.

Yet another prior art miniature UV LED nail gel curing lamp is the "egg" type configuration. These egg-type lamps are shaped like an egg standing on its end. They typically have an opening on one side, sized to allow a user to insert a single fingernail into a miniature treatment chamber, served by one or two UV LEDs. These egg-type lamps are normally activated by the user pressing her finger down on an activation switch on a rubberized pad on the bottom surface of the treatment chamber. These egg-type lamps suffer from accessibility problems for the gel press-on technique. Typically the treatment chamber opening will only admit one (or perhaps two) fingers, thereby making it impossible for a nail technician to reach in to place and hold an artificial finger nail while it is being bonded to the natural nail with a flash cure of UV light. Further, these egg-type lamps are normally closed on three sides, and only allow access to the light from a single direction. Moreover, the placement of the activation button on the bottom surface of the treatment chamber makes it difficult to activate the lamp by pressing the button without accidently knocking off or misaligning the artificial nail that is about to be bonded.

Finally, some nail technicians have taken to using a handheld "flashlight" type or "wand" type UV LED light. Such UV LED lights are difficult to use for the gel press-on technique because, while they do not present access problems, they must be held in place by a nail technician or customer doing her own nails, thus creating yet another "third hand" problem.

Accordingly, there is a need for a miniature, multiple-angle accessible, nail gel flash curing lamp that provides sufficient UV light to flash cure UV-curable nail gel sufficient to bond an artificial nail to a natural fingernail in the gel press-on nail technique, but which minimizes the UV light exposure area and escaping UV light so as to improve safety for eyes and skin, while providing access to the UV light exposure area from multiple directions, such as a 270 degree arc, so that a nail technician or home user can easily place a finger in the UV light exposure area and at the same time have access to reach in with another hand or tool to correctly place and hold an artificial fingernail on the finger prior to and while the flash curing process is occurring, in order to simplify and enable rapid and convenient use of the gel nail press-on technique. Further, there is a need for such a lamp to be self-supporting, so that it may rest upon a flat work surface, thereby obviating the need to hold a flashlight or wand-type light in a "third hand" while performing the gel press-on nail technique. Further there is a need for such a lamp to provide adequate space and access for two hands and/or fingers to be in the light exposure area but with a minimal and optimized distance between the UV LEDs and the fingernail on which the flash curing process is being performed. Thus, there exists an unfulfilled need for an ultraviolet light for curing nail gel that addresses these needs and may overcome these and other concerns.

SUMMARY

The various embodiments of the present miniature, multiple-angle-accessible nail gel curing lamp has several features, no single one of which is solely responsible for its desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments solve the problems discussed in the Background and provide the advantages described herein.

In a first aspect, a nail gel curing lamp is provided and includes a base, a riser extending generally upward from the base, a lamp head extending generally horizontally from the riser, where the lamp head is operatively connectable to a power source and includes an ultraviolet light emitting diode ("UV LED") configured to direct light emitted by the UV LED generally toward the base, thereby defining a light exposure area extending from the UV LED downward toward the base, where an arc of access to the light exposure area is defined as an arc in a plane generally parallel to the UV LED and centered on the UV LED, where the base, the riser and the lamp head are configured to allow unimpeded access of a user's hand to the light exposure area throughout the arc of access and where the arc of access is at least 180 degrees.

In an embodiment of the first aspect, the nail gel curing lamp includes at least one and not more than five, UV LED's.

In another embodiment of the first aspect, the arc of access is equal to or greater than 270 degrees.

In another embodiment of the first aspect, the base, riser and lamp head are integrated as a single structure.

In another embodiment of the first aspect, the lamp head comprises two UV LEDs.

In another embodiment of the first aspect, the lamp head comprises three UV LEDs.

In another embodiment of the first aspect, the nail gel curing lamp comprises a height of access to the light exposure area is defined as the height from the UV LED to the base, where the height of access between the base and the lamp head is between about 35 mm and 65 mm.

In another embodiment of the first aspect, the nail gel curing lamp is no more than 66 mm tall.

In another embodiment of the first aspect, the nail gel curing lamp further includes an activation button for activating the UV LEDs.

In another embodiment of the first aspect, the activation button is located on the riser.

In another embodiment of the first aspect, the activation button is located on the lamp head.

In another embodiment of the first aspect, the activation button is located on the base.

In another embodiment of the first aspect, the nail gel cure lamp further includes a timer with a preselected activation time, where the activation button is operatively connected to the timer, such that when the activation button is pressed, the timer commences and the UV LEDs are activated for the preselected activation time.

In another embodiment of the first aspect, the preselected activation time is at least 10 seconds.

In another embodiment of the first aspect, the preselected activation time is at least 30 seconds.

In another embodiment of the first aspect, the preselected activation time is 60 seconds.

In another embodiment of the first aspect, the base further includes a non-slip surface.

In another embodiment of the first aspect, the UV LEDs emit light at a wavelength between about 330 nm and 440 nm.

In another embodiment of the first aspect, the lamp head further includes recessed apertures for each of the UV LEDs, so that the light emitted by each of the UV LEDs is further directed downwardly and lateral light exposure from the UV LEDs is limited.

In another embodiment of the first aspect, the power source is an internal battery.

In another embodiment of the first aspect, the power source is a mini-USB power connection.

In another embodiment of the first aspect, at least a portion of the lamp is comprised of acetone-resistant material.

In another embodiment of the first aspect, the base comprises a plate.

In another embodiment of the first aspect, the base comprises a ring.

In another embodiment of the first aspect, the base comprises a plurality of horizontal supports.

In another embodiment of the first aspect, the riser comprises a plate.

In another embodiment of the first aspect, the riser comprises a strut.

In another embodiment of the first aspect, the nail gel curing lamp has a height of about 66 mm, a width of about 47 mm, a depth of about 58 mm, a height of access of about 40 mm, and a depth of access of about 43 mm.

In a second aspect, an accessible nail gel curing lamp is provided, including a base, a riser extending generally upward from the base, and a lamp head extending generally horizontally from the riser and operably connectable to a power source where the lamp head has between one and five ultraviolet light emitting diodes ("UV LEDs") configured to direct light emitted by the UV LEDs generally toward the base, thereby defining a light exposure area extending from the UV LED downward toward the base, and where the base, riser and lamp head are configured such that the light exposure area is accessible to a user's hand from three different directions without impediment by the base, riser or lamp head.

In an embodiment of the second aspect, the three different directions are a first direction, a second direction and a third direction, where the first direction, the second direction and the third direction are each vectors in the same plane in the light exposure area and are each offset by 90 degrees from each respective adjacent direction.

In an embodiment of the second aspect, the UV LED comprises at least one and not more than five, UV LED's.

In an embodiment of the second aspect, the arc of access is equal to or greater than 270 degrees.

In an embodiment of the second aspect, the base, riser and lamp head are integrated as a single structure.

In an embodiment of the second aspect, the lamp head comprises two UV LEDs.

In an embodiment of the second aspect, the lamp head comprises three UV LEDs.

In an embodiment of the second aspect, a height of access to the light exposure area is defined as the height from the UV LED to the base, and where the height of access is between about 35 mm and 65 mm.

In an embodiment of the second aspect, the lamp is no more than 66 mm tall.

In an embodiment of the second aspect, the lamp further includes an activation button for activating the UV LEDs.

In an embodiment of the second aspect, the activation button is located on the riser.

In an embodiment of the second aspect, the activation button is located on the lamp head.

In an embodiment of the second aspect, the activation button is located on the base.

In an embodiment of the second aspect, the lamp further includes a timer with a preselected activation time, where the activation button is operatively connected to the timer, such that when the activation button is pressed, the timer commences and the UV LEDs are activated for the preselected activation time.

In an embodiment of the second aspect, the preselected activation time is at least 10 seconds.

In an embodiment of the second aspect, the preselected activation time is at least 30 seconds.

In an embodiment of the second aspect, the preselected activation time is 60 seconds.

In an embodiment of the second aspect, the base further includes a non-slip surface.

In an embodiment of the second aspect, the UV LEDs emit light at a wavelength between about 330 nm and 440 nm.

In an embodiment of the second aspect, the lamp head further includes recessed apertures for each of the UV LEDs, so that the light emitted by each of the UV LEDs is further directed downwardly and lateral light exposure from the UV LEDs is limited.

In an embodiment of the second aspect, the power source is an internal battery.

In an embodiment of the second aspect, the power source is a mini-USB power connection.

In an embodiment of the second aspect, at least a portion of the lamp is comprised of acetone-resistant material.

In an embodiment of the second aspect, the base comprises a plate.

In an embodiment of the second aspect, the base comprises a ring.

In an embodiment of the second aspect, the base comprises a plurality of horizontal supports.

In an embodiment of the second aspect, the riser comprises a plate.

In an embodiment of the second aspect, the riser comprises a strut.

In a third aspect, an accessible nail gel curing lamp is provided, including a base, a riser extending generally upward from the base, a lamp head extending generally horizontally from the riser, where the lamp head is operatively connectable to a power source and comprises an ultraviolet light emitting diode ("UV LED") configured to direct light emitted by the UV LED generally toward the base, thereby defining a light exposure area extending from the UV LED downward toward the base, and where an arc of access to the light exposure area is defined as an arc in a plane generally parallel to the UV LED and centered on the UV LED, where the base, the riser and the lamp head are configured to allow unimpeded access of a user's hand to the light exposure area throughout the arc of access, wherein the arc of access is at least 180 degrees, an alternative activation mechanism located within the light exposure area, wherein the alternative activation mechanism is operably connected to the UV LED, such that the user may activate the UV LED when the user's hand is within the light exposure area.

In an embodiment of the third aspect, the alternative activation mechanism activates the UV-LED without the user actuating a primary activation mechanism positioned outside of the light exposure area.

In another embodiment of the third aspect, the alternative activation mechanism is a mechanical button switch positioned on the base within the light exposure area.

In another embodiment of the third aspect, the alternative activation mechanism is a touch switch.

In another embodiment of the third aspect, the touch switch is a capacitance switch In another embodiment of the third aspect, the touch switch is a resistance switch.

In another embodiment of the third aspect, the touch switch is a piezo touch switch.

In another embodiment of the third aspect, the alternative activation mechanism is a motion sensor.

In another embodiment of the third aspect, the alternative activation mechanism is a passive infra-red sensor.

In another embodiment of the third aspect, the alternative activation mechanism is an active infra-red sensor.

In another embodiment of the third aspect, the nail gel curing lamp also includes a timer, operably connected to the alternative activation mechanism, where the timer is configured such that, upon actuation of the alternative activation mechanism by a user, the timer counts down an activation delay period, and where the timer causes the UV-LED to activate only after expiration of the activation delay period.

In another embodiment of the third aspect, the activation delay period is between one second and five seconds.

In another embodiment of the third aspect, the activation delay period is two seconds.

In another embodiment of the third aspect, the alternative activation mechanism includes an infra-red transmitter and an infra-red receiver, where the infra-red transmitter is positioned in the lamp head and aimed downwardly, where the infra-red receiver is positioned in the base such that it is generally aligned with the infra-red transmitter, where when the infra-red transmitter is transmitting, a beam path is created between the transmitter and receiver and where the presence of an obstruction in the beam path will close an activation circuit that activates the UV-LED.

BRIEF DESCRIPTION OF THE DRAWINGS

In the descriptions that follow, like parts or steps are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein.

DETAILED DESCRIPTION

The present embodiments disclose and describe a miniature, multiple-angle accessible, ultra-violet LED powered, nail gel flash curing lamp, which is particularly useful for the gel press-on technique of applying artificial finger nails. The embodiments disclosed herein are intended to be instructional and not limiting to the scope of the claims, except where specifically set forth. Moreover, while the description focuses on certain embodiments and uses, it will be understood that this disclosure is non-limiting, and the present embodiments could be applicable to other applications for which a miniature UV LED lamp would be useful.

Figure 1:
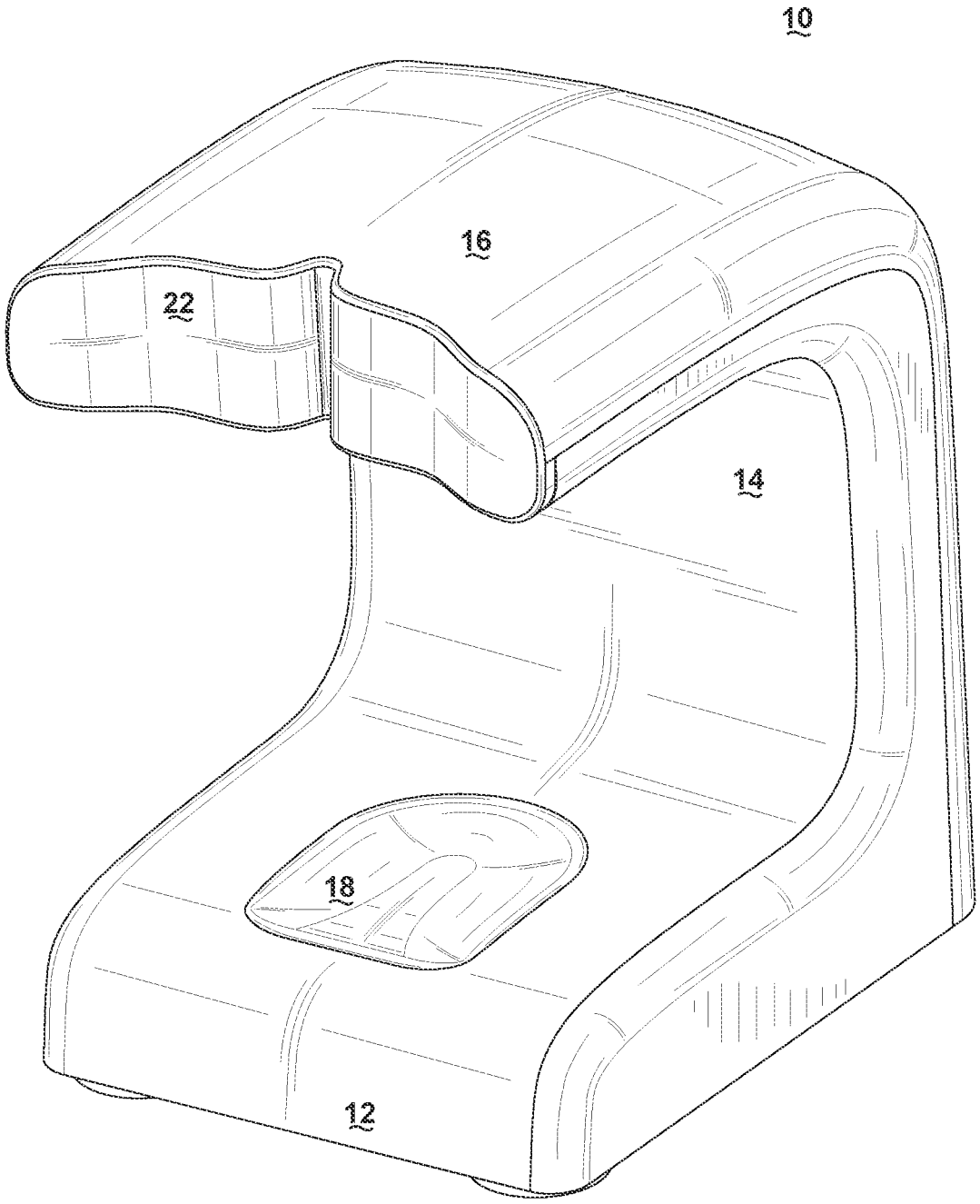
FIG. 1 illustrates a top front perspective view of an embodiment of the nail lamp.

With reference to FIG. 1, an embodiment of a miniature, multiple-angle accessible, ultraviolet nail gel curing lamp 10 is illustrated. The lamp 10 includes a base 12, a riser 14 and a lamp head 16. In the embodiment shown, the base 12, the riser 14 and the lamp head 16 are integrated as a single unit, but they need not be so. The base 12 also includes a finger placement depression 18. The lamp head 16 also includes a purely decorative "curly brace" scroll design 22 along its outer edge.

Figure 2:
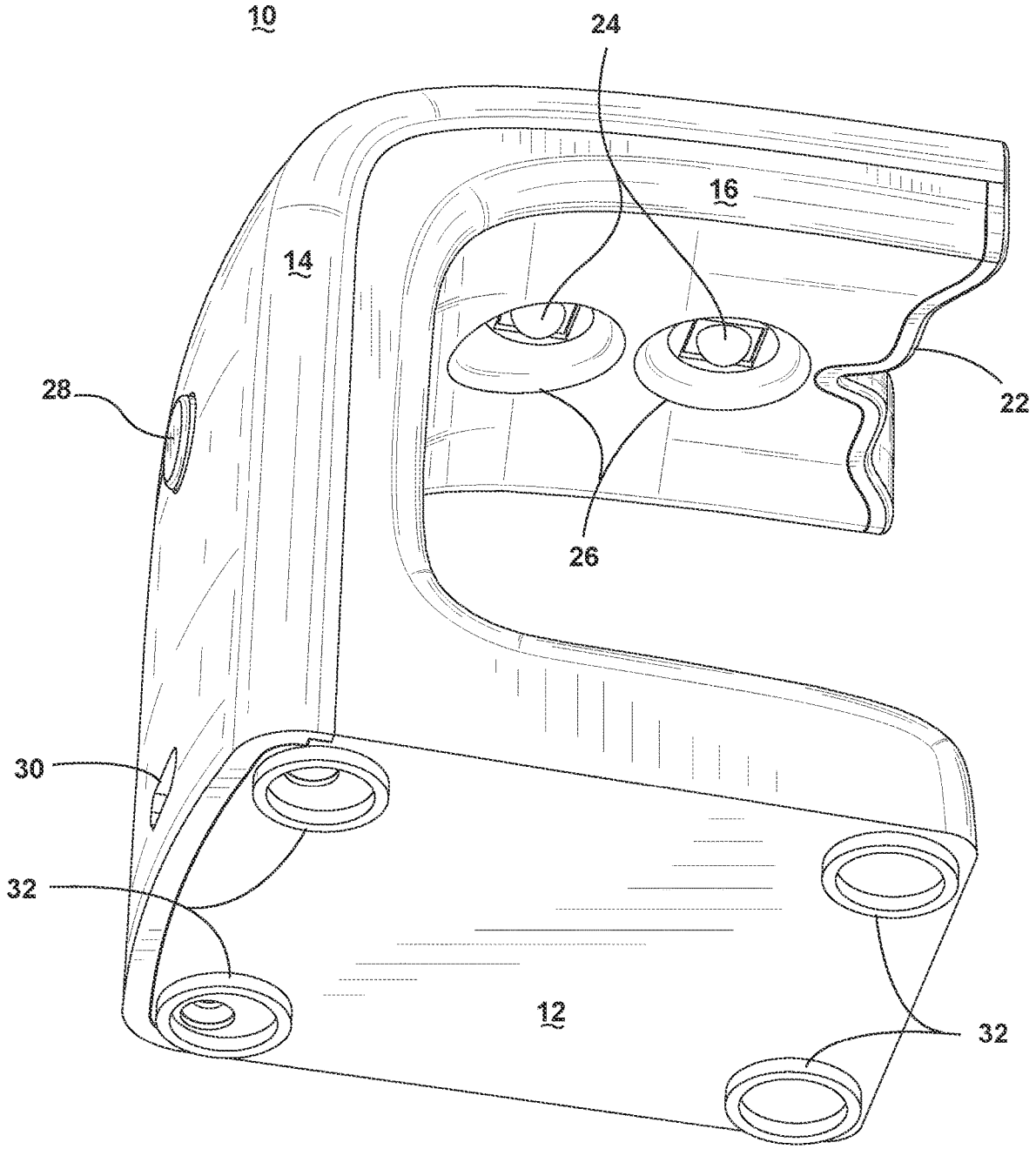
FIG. 2 illustrates a bottom side perspective view of the nail lamp of FIG. 1.

With reference to FIG. 2, the embodiment of the lamp 10 also includes two UV LED's 24, each in its respective recess 26 on the underside of the lamp head 16. Each UV LED 24 is operatively attached to an electrical power source. In various embodiments, the lamp head 16 may include one, two, three, four, five or even six UV LEDs. The UV LEDs 24 are tuned to emit ultraviolet light in a spectrum of between approximately 330 nm and 440 nm. In one embodiment, the light spectrum emitted is 400 nm, for the curing of commercially available UV-curable nail gel. The lamp 10 also includes an activation button 28 on the riser 14. However, in other embodiments not shown, the activation button 28 may be located on the lamp head 16, or the base 12. The lamp 10 may also include a timer, operatively connected to the activation button 28. The timer may be set to one or more pre-selected activation times, such as 10 seconds, 15 seconds, 20 seconds, 30 seconds, 45 seconds, and 60 seconds. The timer is, in turn, operatively connected to the UV LED's 24, and upon expiration of the pre-selected activation time, the timer activates a switch to turn off the UV LED's 24.

The embodiment of the lamp 10 includes a mini-USB port 30, for providing electrical power to the lamp 10. In some embodiments, not shown, the lamp 10 includes a rechargeable internal battery for wireless operation. In such embodiments, the mini-USB port 30 may be used to charge the internal battery. In other embodiments, not shown, the lamp 10 may use non-rechargeable batteries, such as AA alkaline batteries, for its electrical power source. The base 12 includes feet 32 for supporting the lamp 10 on a flat surface such as a table. The feet 32 may be rubberized, or of some other non-skid substance, to prevent or reduce the potential for the lamp to slide if it is bumped during use.

Figure 3:
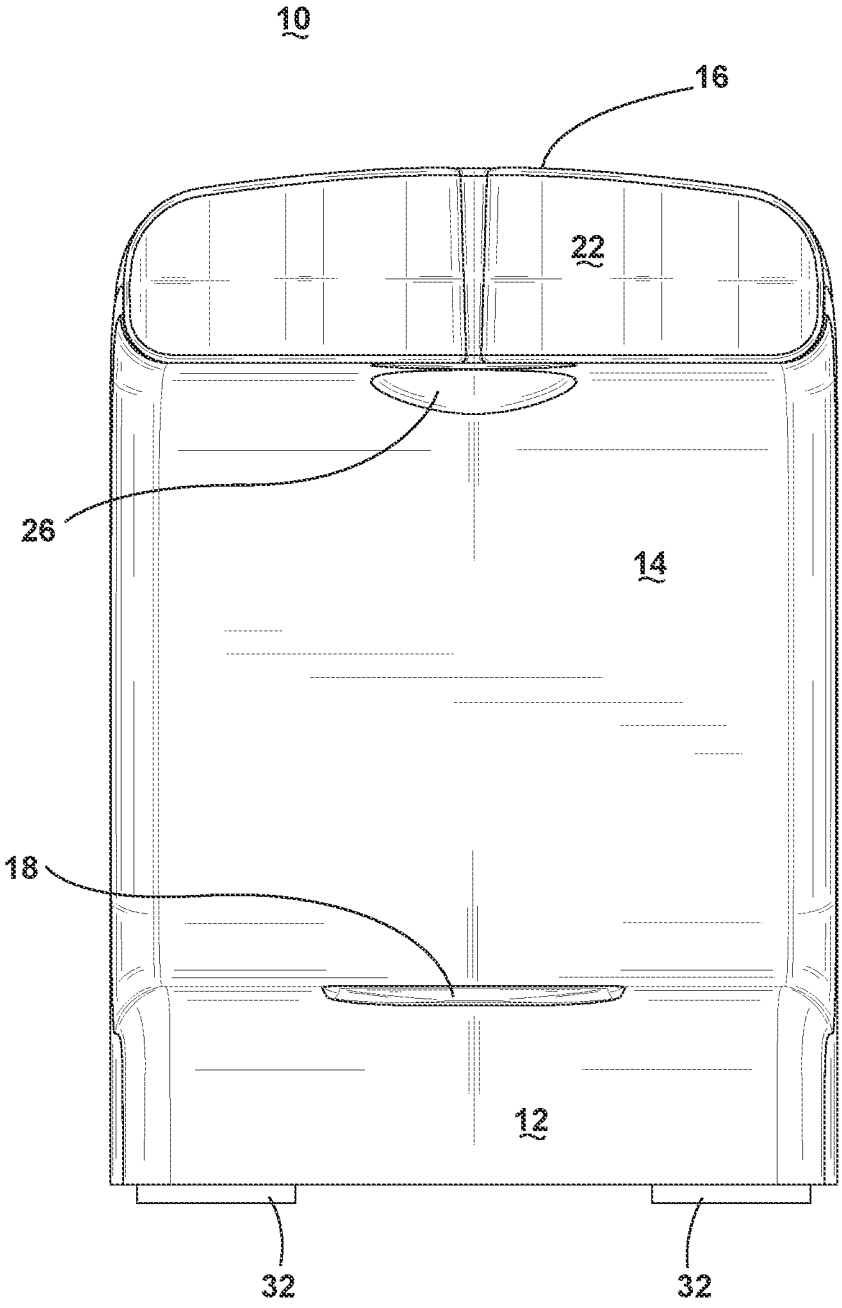
FIG. 3 illustrates a front view of the nail lamp of FIG. 1.
Figure 4:
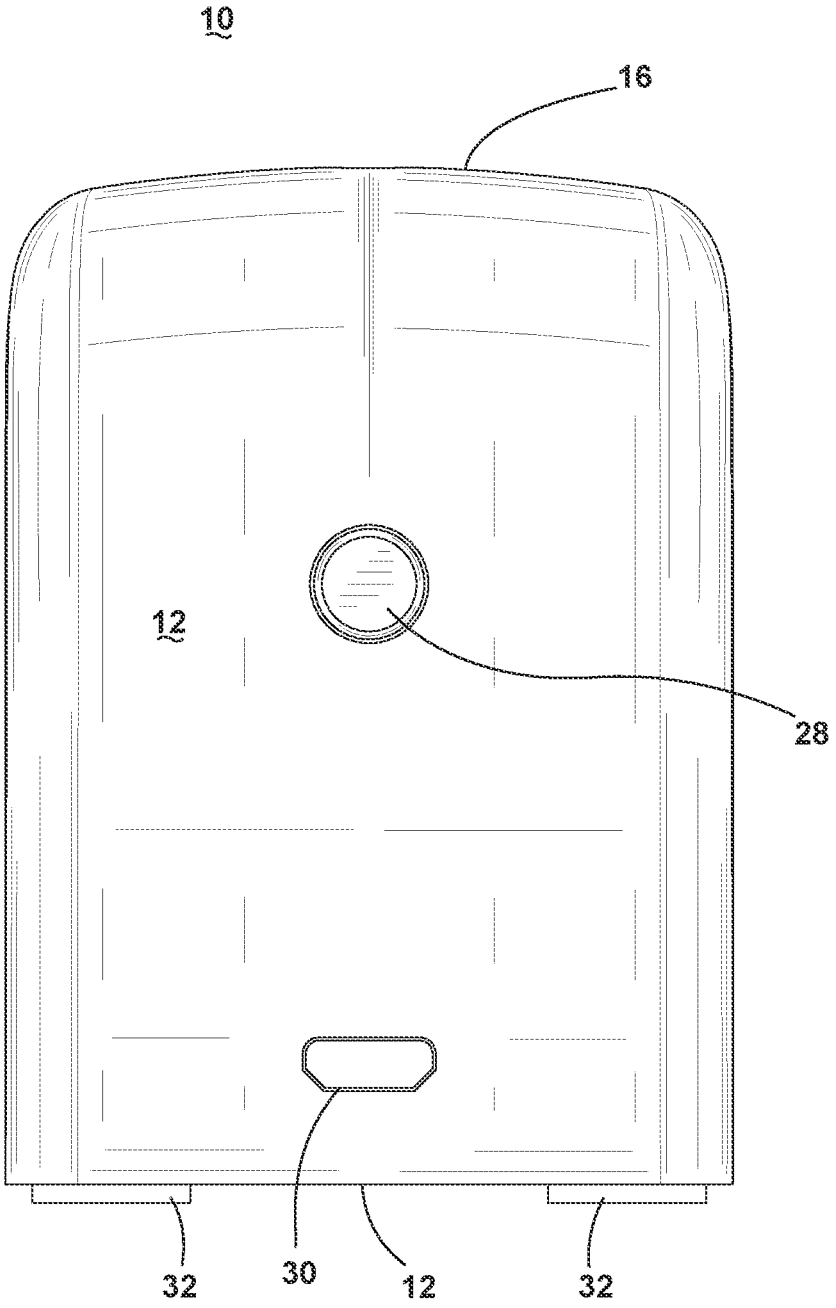
FIG. 4 illustrates a back view of the nail lamp of FIG. 1.
Figure 5:
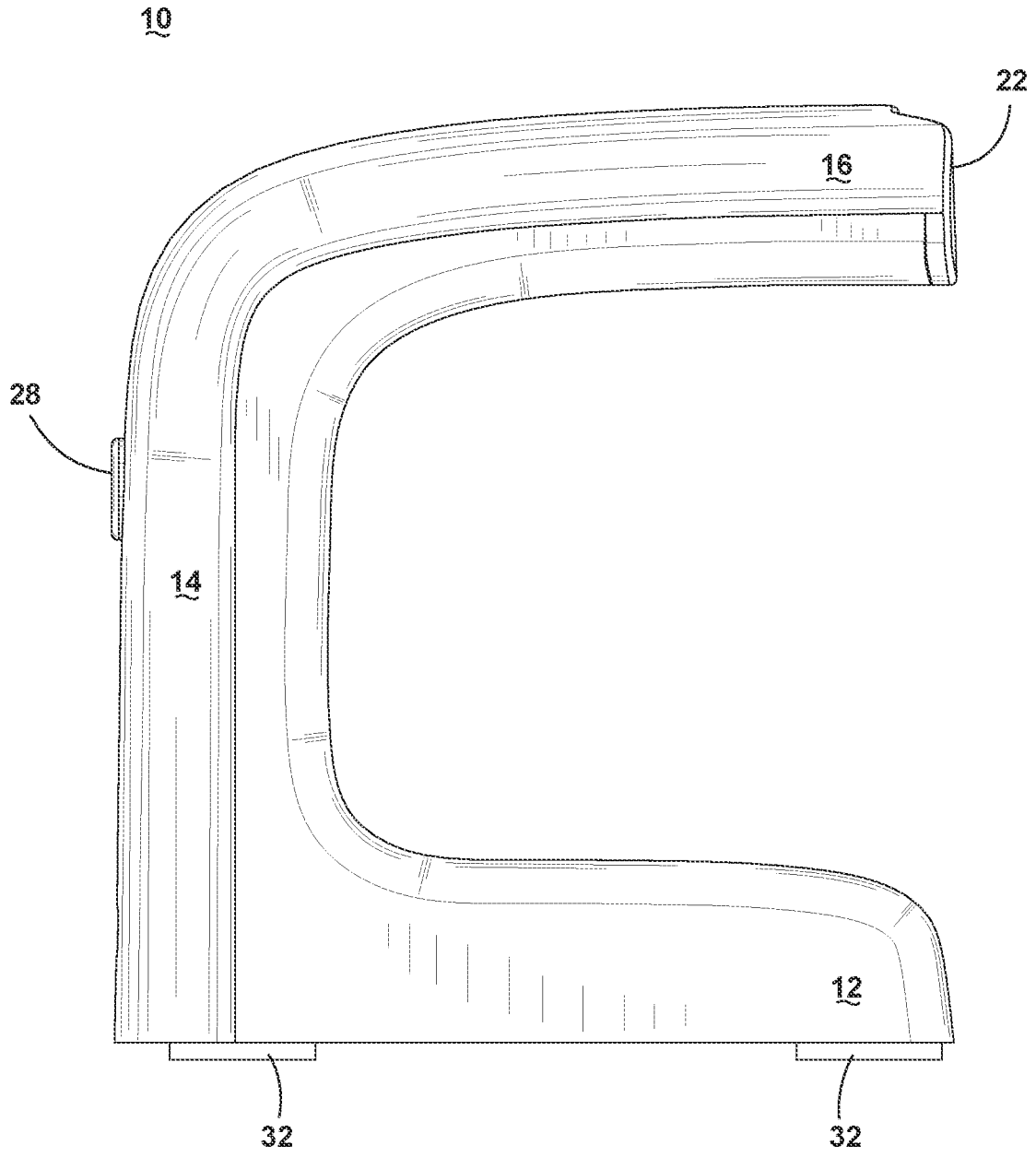
FIG. 5 illustrates a left side view of the nail lamp of FIG. 1.

With reference to FIGS. 3-5, additional views of the embodiment of the lamp 10 are illustrated, including, respectively, a front view, a back view, and a left side view.

In certain embodiments, the lamp has exemplary dimensions of a height of 66 mm, a depth of 58 mm, and a width of about 47 mm. In another embodiment, the lamp has exemplary dimensions of a height of about 66 mm, a width of about 47 mm, a depth of about 58 mm, a height of access of about 40 mm, and a depth of access of about 43 mm.

In certain alternative embodiments of the lamp 10, not shown, the base 12 may have an alternative structure, such as a plate, a ring, or a plurality of horizontal supports, so long as the base 12 serves to hold the rest of the lamp 10 in a stable and upright position. Similarly, in certain alternative embodiments of the lamp 10, not shown, the riser 14 may have an alternative structure, such as a plate, a strut, a rod or a bar, so long as the riser 14 serves to hold the rest of the lamp 10 in a stable and upright position, and provides for an unimpeded arc of access to the light exposure area as discussed herein.

Figure 6:
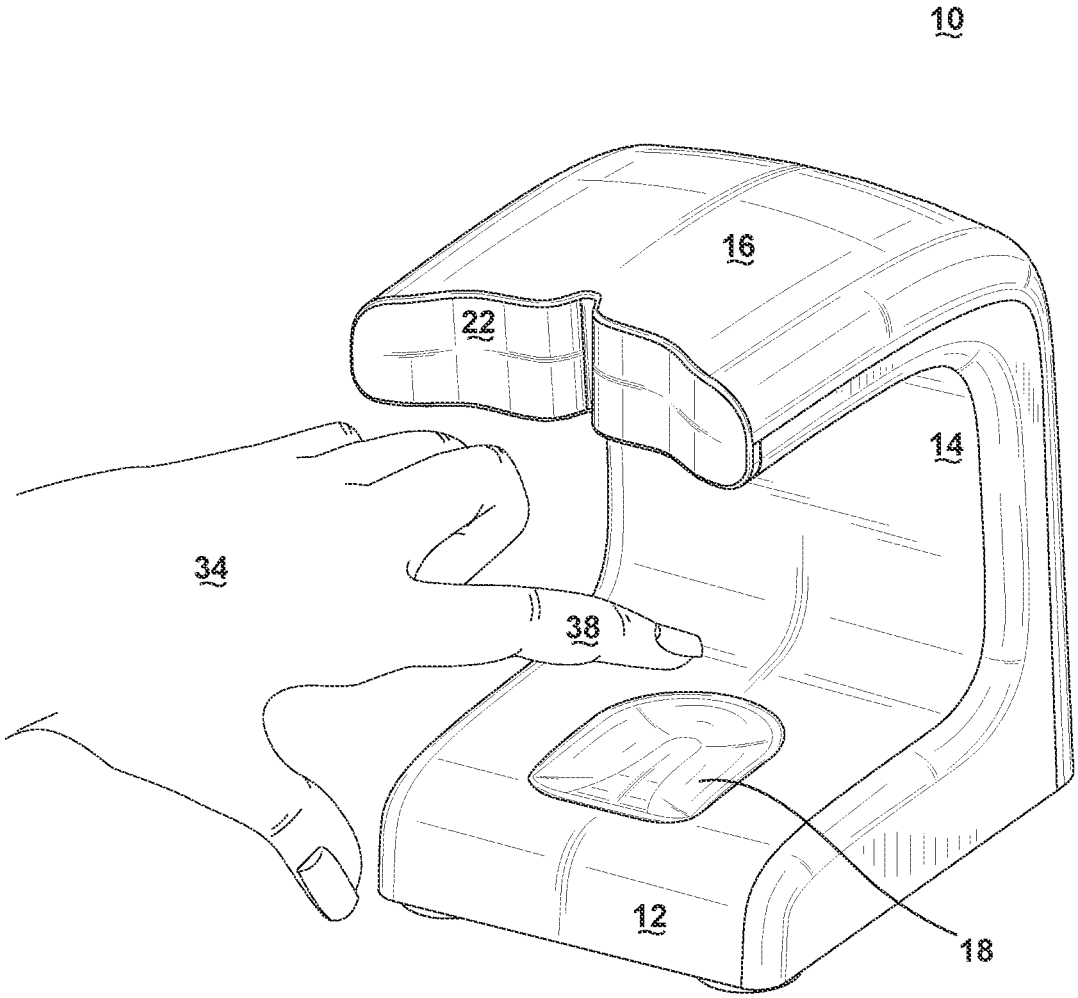
FIG. 6 illustrates a top front perspective view of the embodiment of the nail lamp of FIG. 1 in preparation for use.
Figure 7:
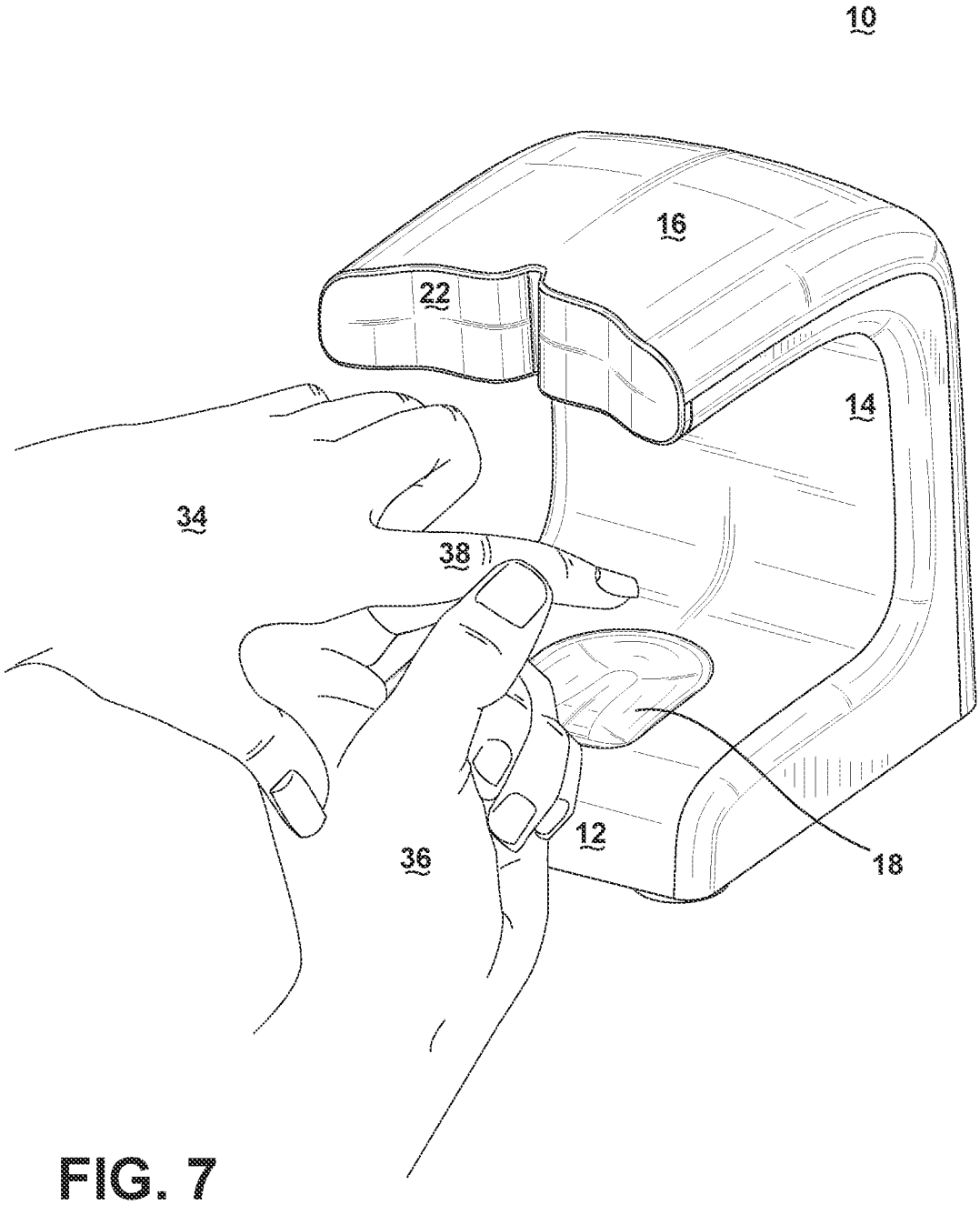
FIG. 7 illustrates another view of the nail lamp of FIG. 1 in further preparation for use.
Figure 8:
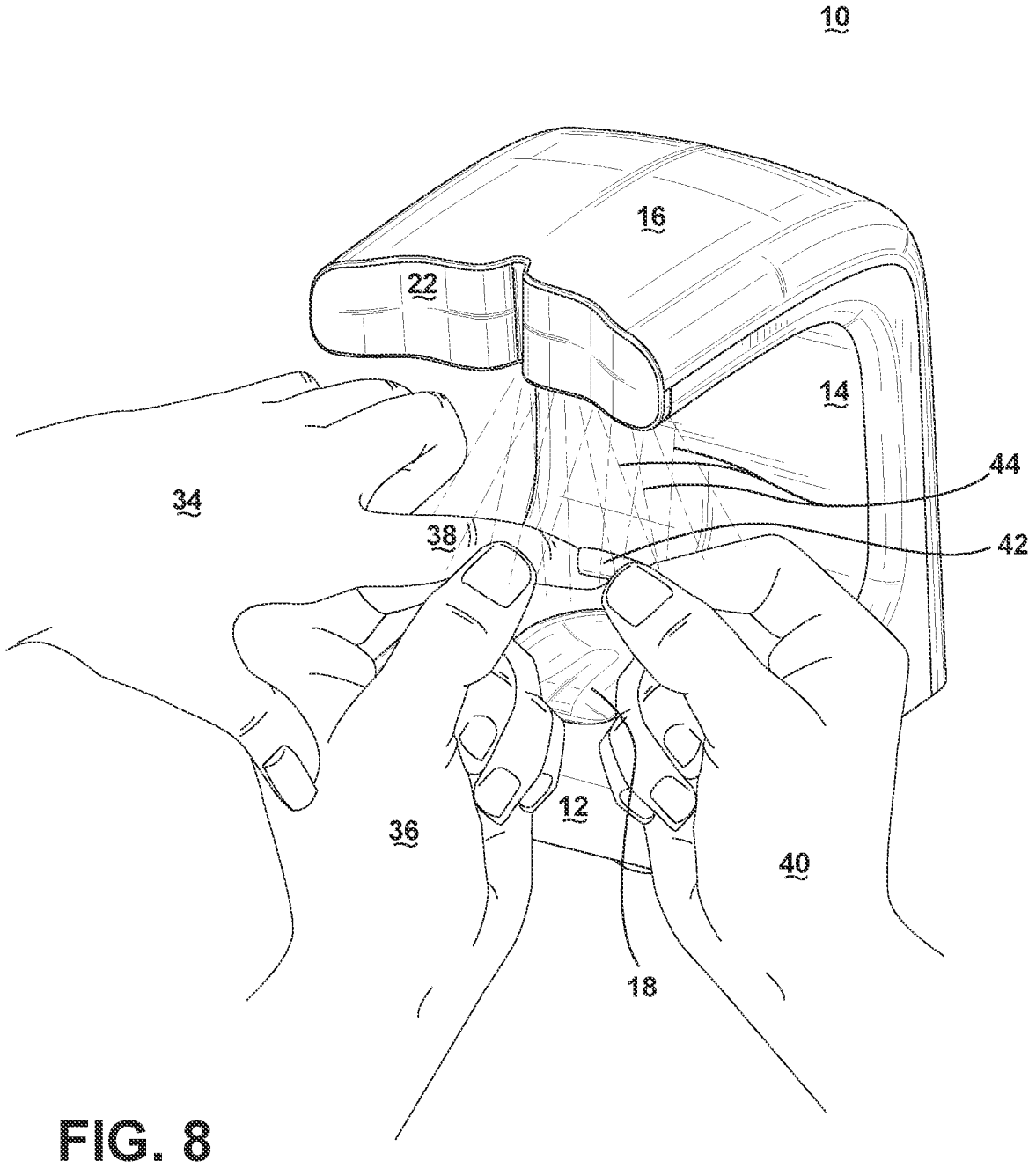
FIG. 8 illustrates another view of the nail lamp of FIG. 1 in use.

With reference to FIGS. 6-8, a method of use is illustrated, highlighting one of the benefits of the embodiment, namely the multiple angle accessibility of the lamp 10, particularly for use in the gel press-on nail technique. In FIG. 6, a customer holds her hand 34 in position under the lamp 10, with her finger 38 extended in anticipation of receiving a gel press-on nail prepared as discussed herein with UV-curable nail gel. In FIG. 7, the technician uses her left hand 36 to hold the customer's finger 38 in proper position generally under the UV-LEDs 24 of the lamp head 16. In FIG. 8, the technician uses her right hand 40 to hold and correctly place an artificial nail 42 onto the cuticle of the customer's finger 38. The technician may activate the lamp 10 either immediately prior to placement of the artificial nail 42, or immediately after. The technician will press and hold the artificial fingernail 42 in place on the customer's finger 38, to ensure proper placement and eliminate air bubbles, while the UV-LED's 24 are active and projecting UV light 44 downwardly so that the artificial nail 42 is bonded to the client's finger 38 by at least a partial cure of the UV-curable nail gel. The amount of time needed for this partial cure varies, but can range from as little as ten seconds, to thirty seconds, to as long as one minute. Thus, FIGS. 6-8 illustrate the ability of a nail tech to use both hands, while maneuvering and manipulating a client's finger 38, under the lamp head 16. This ability is, at least in part, the result of the configuration of the base 12, riser 14 and lamp head 16, so as to provide three open sides to the area under the UV-LED's 24.

Figure 9:
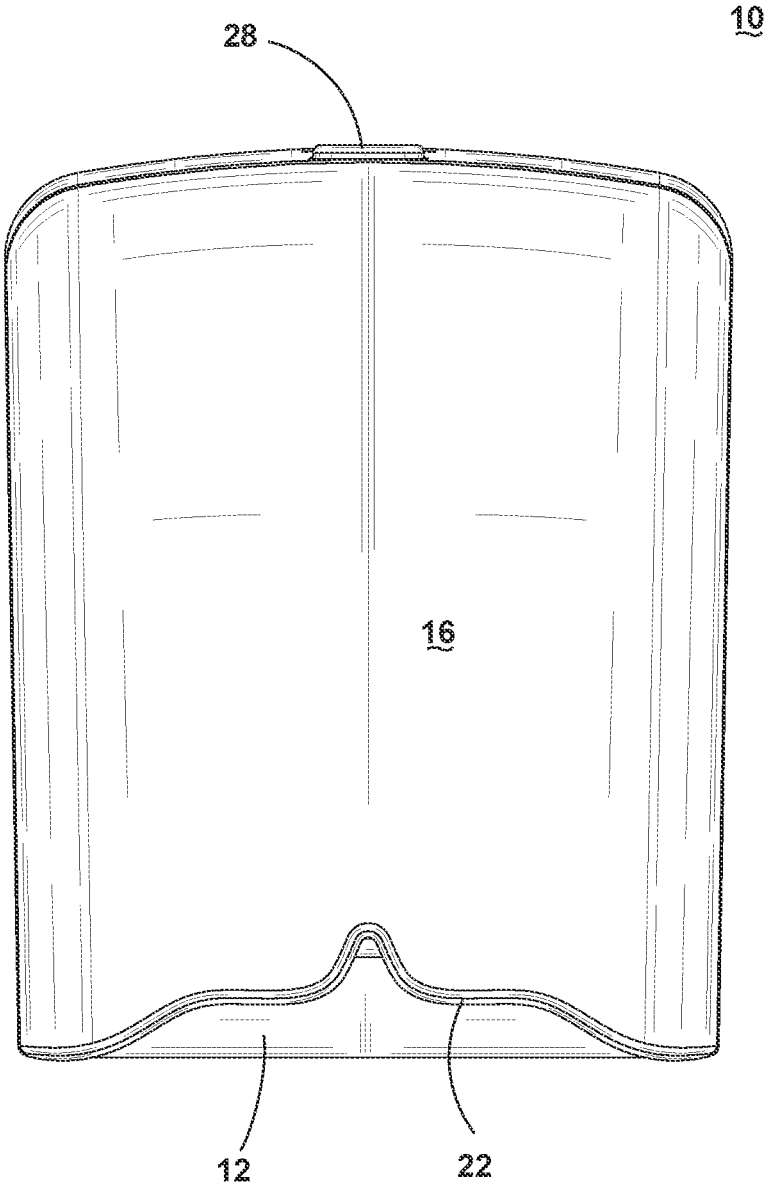
FIG. 9 illustrates a top view of the nail lamp of FIG. 1.
Figure 10:
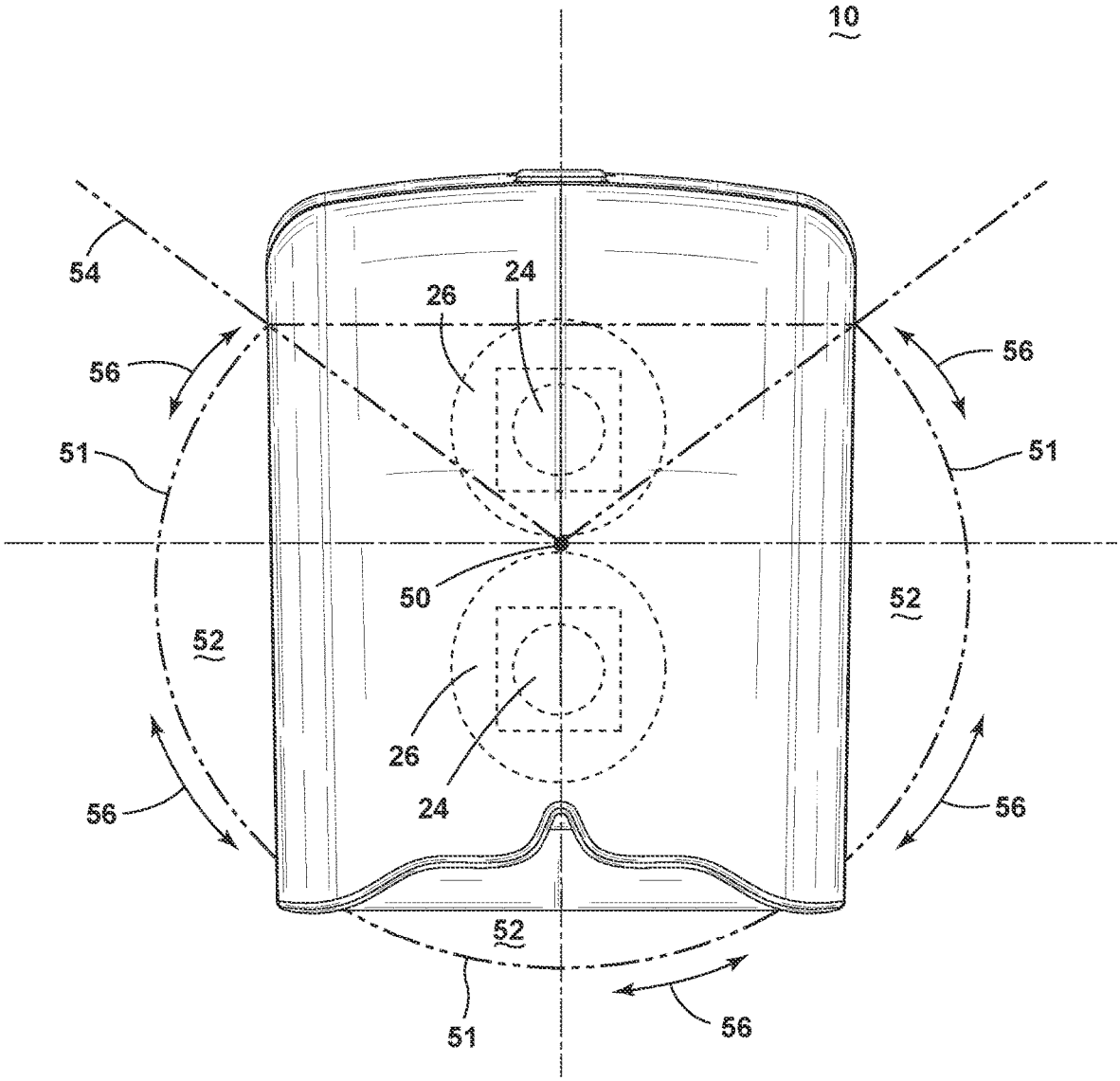
FIG. 10 illustrates a top view of the nail lamp of FIG. 1, with an arc of access to the light exposure area shown.
Figure 11:
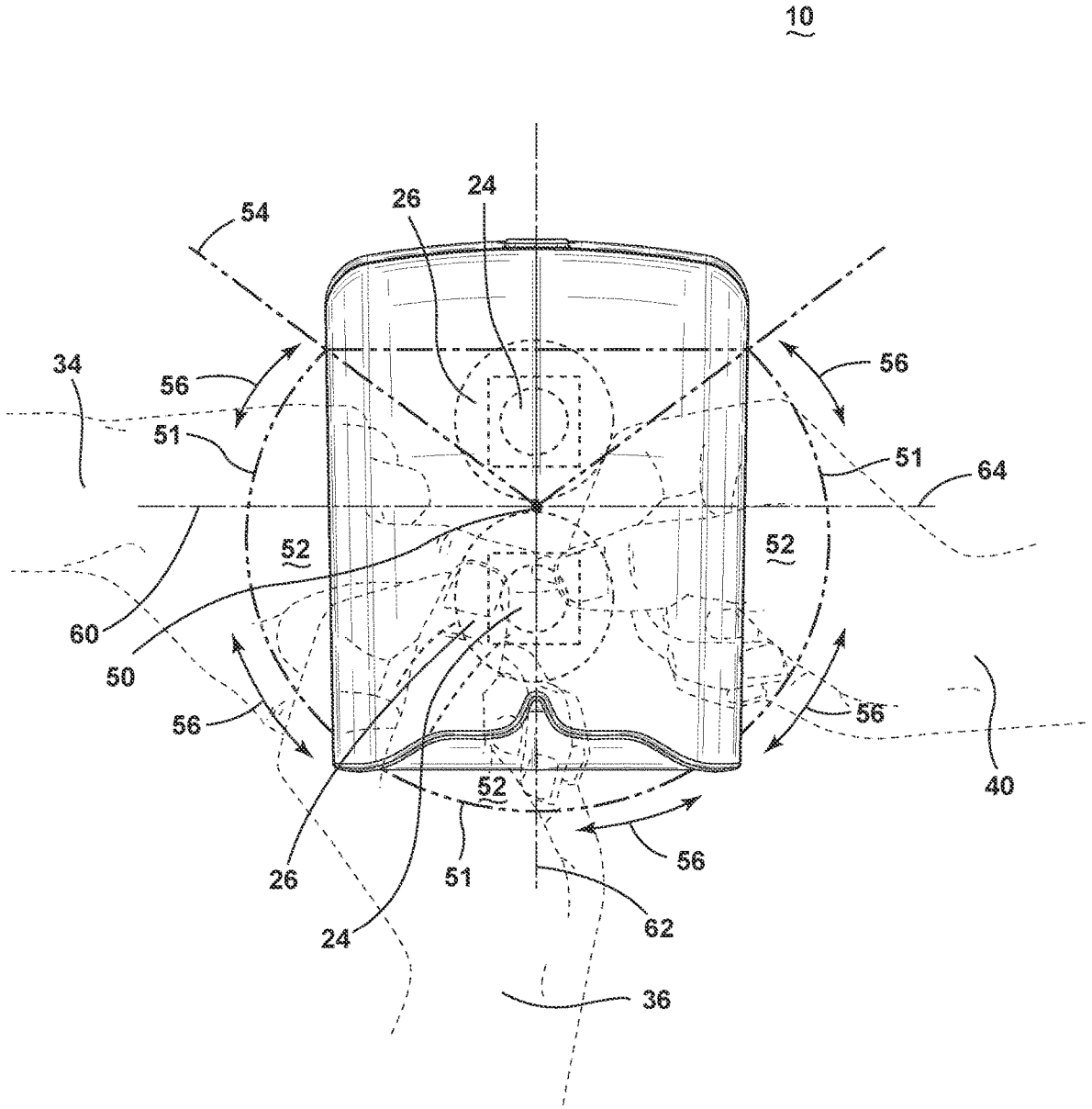
FIG. 11 illustrates a top view of the nail lamp of FIG. 1, with an arc of access to the light exposure area shown, and further illustrating the hand of a customer and the hands of a nail technician engaged in an exemplary use of the nail lamp.

This multiple-angle accessibility feature is further illustrated in the overhead views of FIGS. 9-11. FIG. 9 illustrates a top view of an embodiment of the nail lamp 10. FIG. 10 builds upon FIG. 9 and includes dashed lines to indicate the relative position of the two UV-LEDs 24 within their recesses 26. FIG. 10 also includes a center point 50 of the UV-LEDs 24 and a dashed line 51 illustrating the light exposure area 52 that the UV-LEDs 24 generate when the UV-LEDs 24 are activated. Lines 54 extend outwardly from the center point 50, to the edge of the riser 14. When viewed in a plane, these lines 54, in combination with the dashed line 51, define an arc of access 56 to the light exposure area 52. Specifically, a nail tech and a customer may access the light exposure area 52, with their hands 34, 36, 40, without impediment by the base 12, the riser 14 or the lamp head 16, from any point along the arc of access 56. In the embodiment shown in FIG. 10, the arc of access 56 is greater than 180 degrees, and in fact is at least 270 degrees.

With respect to FIG. 11, which builds upon FIG. 10, a broken line illustration shows the customer's left hand 34, the nail tech's left hand 36 and the nail tech's right hand 40. As can be seen, the customer's left hand 34 (or right hand, not shown), the nail tech's left hand 36 and the nail tech's right hand 40 each can easily access the light exposure area 52 under the lamp head 16, each from a different direction along the arc of access 56. Specifically, the customer's left hand 34 accesses the light exposure area 52 along a first direction 60, the nail tech's left hand 36 accesses the light exposure area 52 along a second direction 62, and the nail tech's right hand 40 accesses the light exposure area 52 along a third direction 64. The first direction 60, second direction 62, and third direction 64 are each off-set approximate ninety degrees from each adjacent direction.

Figure 12:
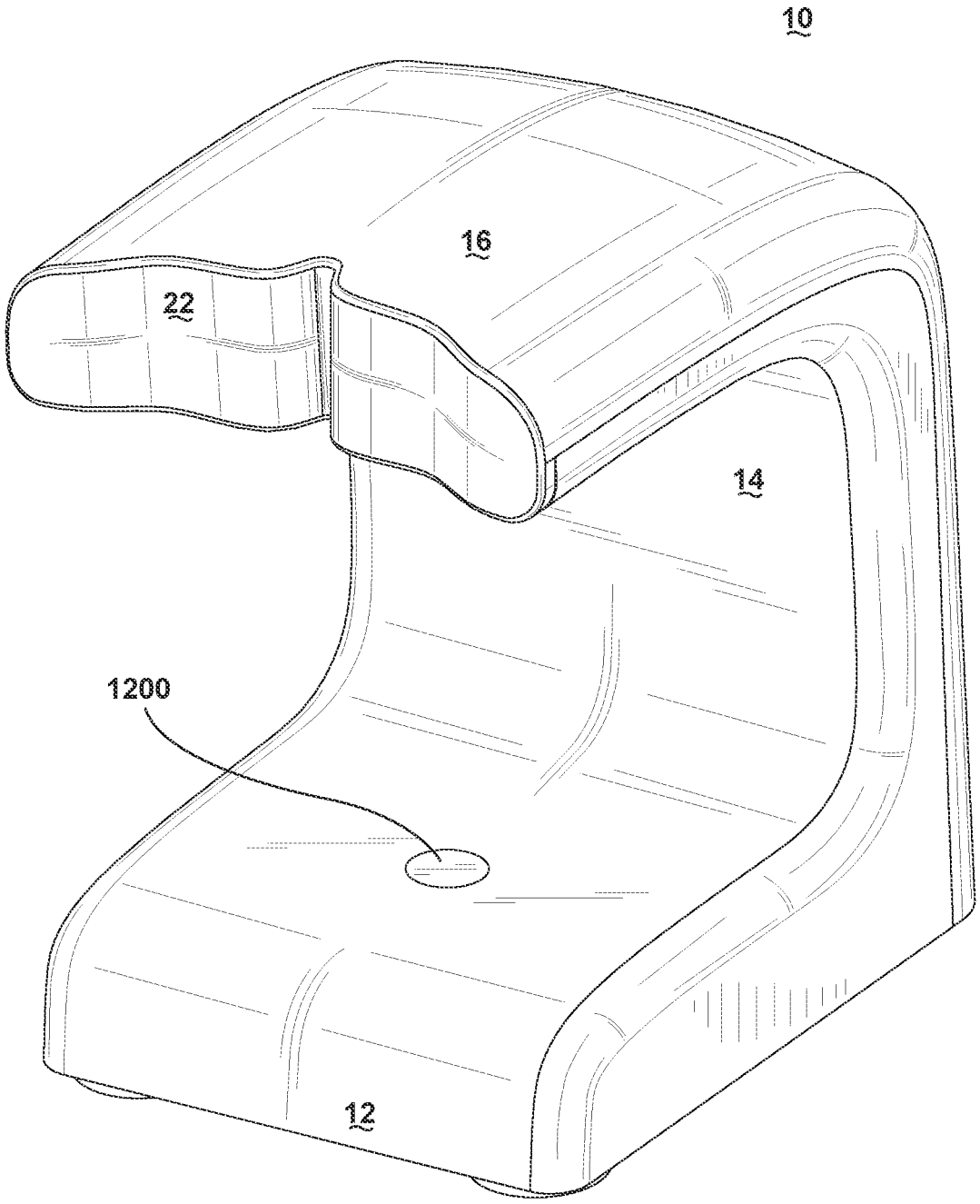
FIG. 12 illustrates a top front perspective view of a second embodiment of the nail lamp with an alternative activation button on the base, within the light exposure area.

With respect to FIG. 12, a second embodiment of the nail lamp is shown, with an alternative activation mechanism. Instead of the finger placement depression 18 shown in FIG. 1, the embodiment of FIG. 12 includes an alternative activation mechanism 1200 located on the base 12. The alternative activation mechanism 1200 is electrically coupled to the UV-LEDs 24, such that when the alternative activation mechanism 1200 is touched or pressed, the UV-LEDs 24 are activated. The alternative activation mechanism 1200 may be a touch switch, a mechanical button switch, or any other known "press-able" or "touchable" switch for activating an electrical circuit. The alternative activation mechanism 1200 may be instead of, or in addition to, the activation button 28.

As to a touch switch, various alternative embodiments exist and are contemplated herein. On type of touch switch is a capacitance switch. A capacitance switch needs only one electrode to function. The electrode can be placed behind a non-conductive panel such as wood, glass, or plastic. In certain embodiments herein, the non-conductive panel is plastic. The capacitance switch works using body capacitance, a property of the human body that gives it electrical characteristics. The capacitance switch continuously charges and discharges to detect changes in capacitance. When a person touches the metal exterior of the switch (or the non-conductive panel covering it), their body increases the capacitance and triggers the switch. Capacitance switches are available commercially as integrated circuits from a number of manufacturers. These devices can also be used as a short-range proximity sensor.

Another type of touch switch is a resistance switch. A resistance switch needs two electrodes to be physically in contact with something electrically conductive (for example a finger) to operate. The resistance switch works by lowering the resistance between two pieces of metal. A resistance switch is thus much simpler in construction compared to the capacitance switch. Placing one or two fingers across the plates achieves a turn on or closed state. Removing the finger(s) from the metal pieces turns the device off. One implementation of a resistance switch is two Darlington-paired transistors where the base of the first transistor is connected to one of the electrodes. Also, an N-Channel, enhancement-mode, metal oxide field effect transistor can be used. Its gate can be connected to one of the electrodes and the other electrode through a resistance to a positive voltage.

Yet another type of touch switch is a Piezo switch, which is sometimes also called a Surface acoustic wave (SAW) touch sensor. The SAW touch sensor measures the disturbance of ultrasonic waves sent across the surface of a glass layer. It consists of Piezoelectric crystals attached to the glass layer on an LCD display, making such sensing possible.

Piezo touch switches are based on mechanical bending of piezo ceramic, typically constructed directly behind a surface. This solution enables touch interfaces with any kind of material. Another characteristic of piezo is that it can function as actuator as well. Current commercial solutions construct the piezo in such a way that touching it with approximately 1.5 N is enough, even for stiff materials like stainless steel. Piezo touch switches are available commercially.

A still further type of touch sensor is the infrared touch sensor. Infrared touch sensor measures touch through whether the emitting LED beam is broken or changed when an object makes contact with it. Commonly used in kiosks or gaming applications, infrared touch sensors are long-lasting and insensitive to pressure (similar to a capacitive touch sensor). Infrared touch sensors operate on the basis of light-beam interruption, commonly referred to as beam break, to determine the location of touch events. Infrared uses an array of X-Y infrared LED and photo detector pairs around the edges of the screen or touch pad to detect a disruption in the pattern of LED beams. These LED beams cross each other in vertical and horizontal patterns. As an object touches the screen, it interrupts the light-beam causing a loss of light at the sensor. This loss of light is used to determine the location of the touch event, helping the sensors pick up the exact location of the touch. A major benefit of such a system is that it can detect essentially any input including a finger, gloved finger, stylus, or pen. Infrared touch sensors are available commercially.

Figure 13:
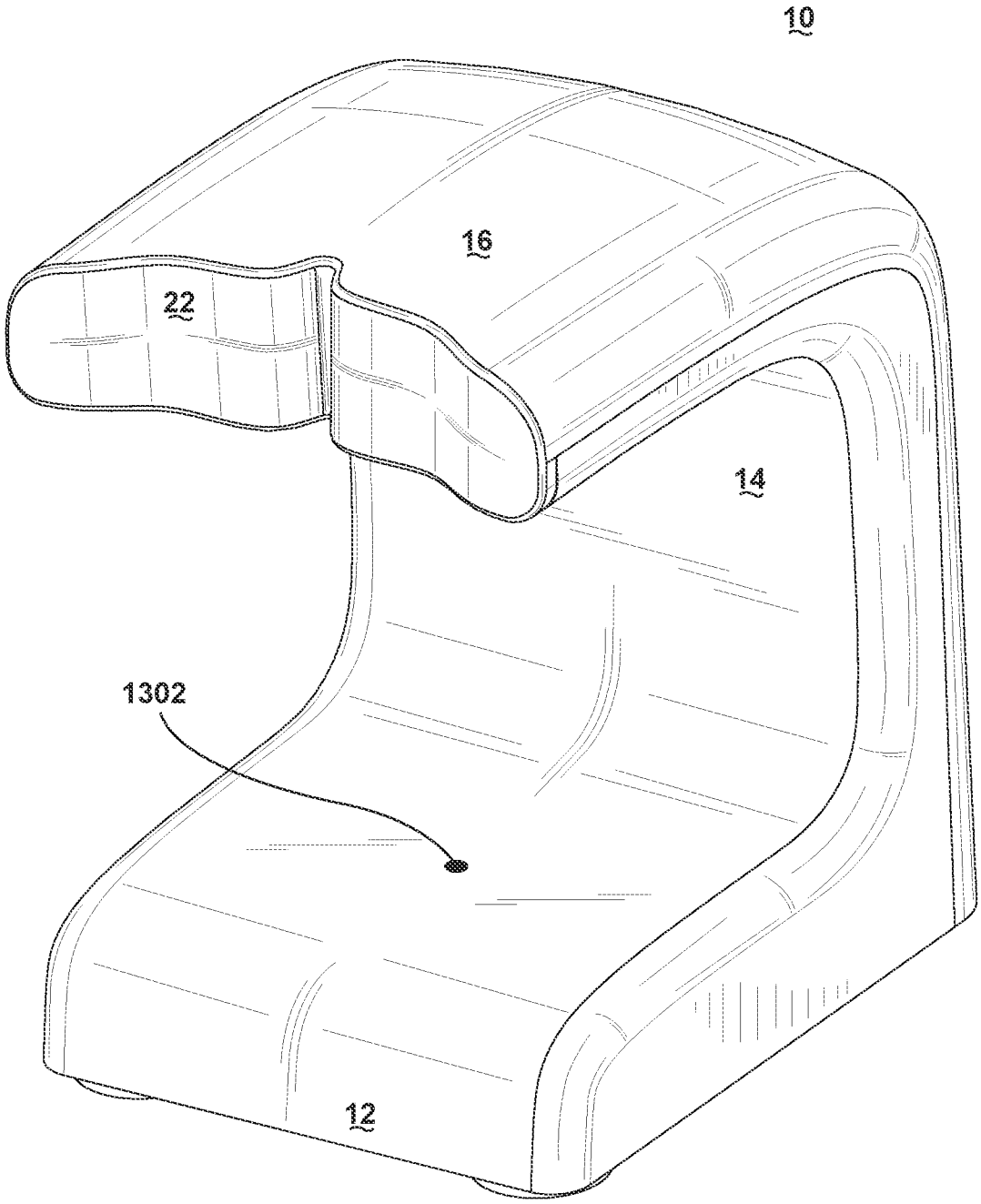
FIG. 13 illustrates a top front perspective view of a third embodiment of the nail lamp, which activates the UV-LED's when the user's hand triggers a motion sensor in the light exposure area.
Figure 14:
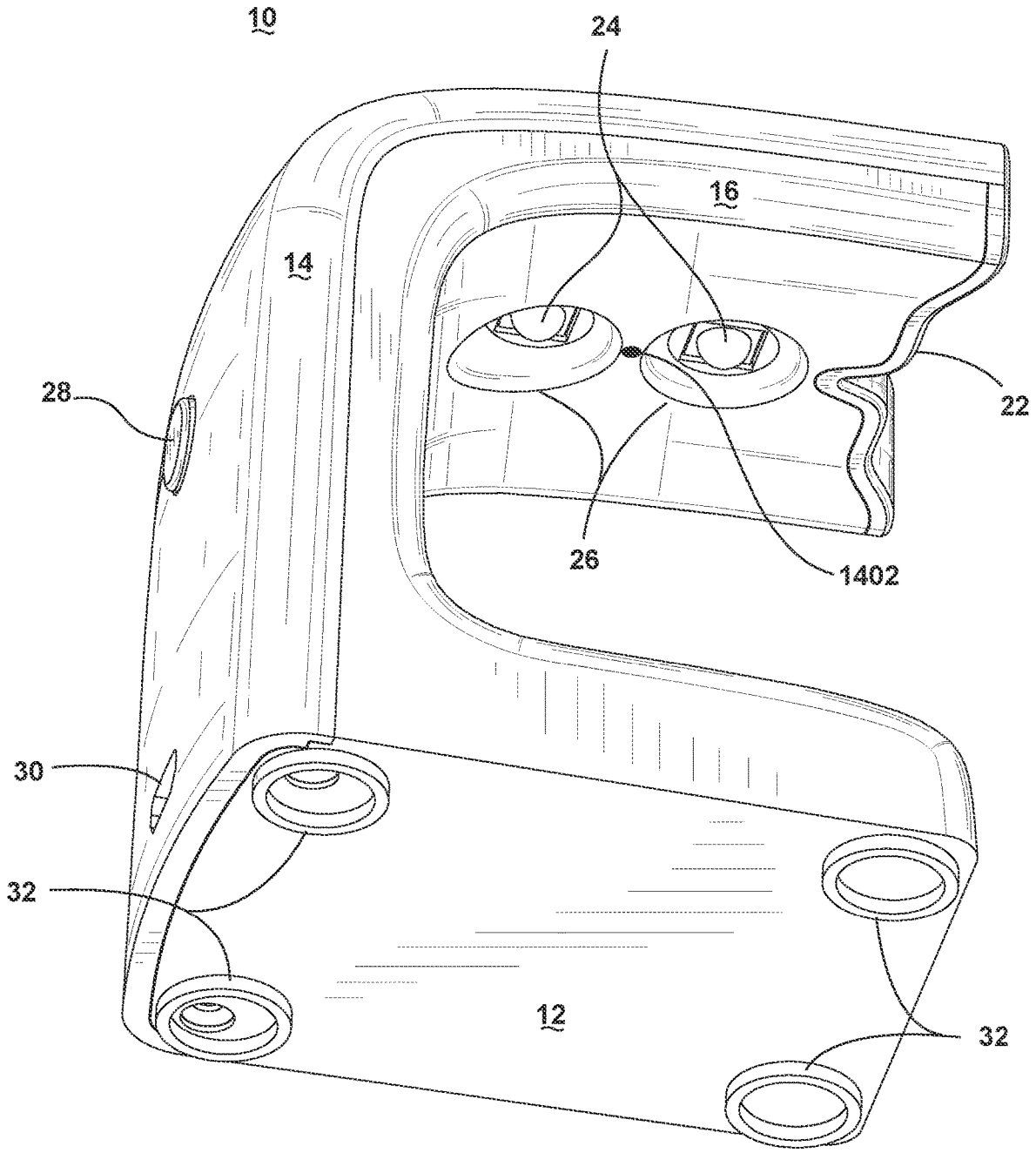
FIG. 14 illustrates a bottom side perspective view of the third embodiment of FIG. 13.

With respect to FIG. 13, a third embodiment of the nail lamp is shown, with a still further alternative activation mechanism. The embodiment of FIG. 13 includes a sensor that detects the presence of a user's fingers or hand within the light exposure area 52, and activates the UV-LEDs when such presence is detected, in order to enable "hands-free activation" of the UV-LEDs. Such devices are commonly referred to as "motion sensors" and can include both active infra-red sensors, and passive infra-red sensors. For example, one embodiment illustrated in FIGS. 13-14, the sensor is an active paired infra-red receiver 1302 and infra-red transmitter 1402. The infra-red receiver 1302 is positioned in the base 12, generally within the light exposure area 52, and in this case, in place of the finger depression 18 shown in FIG. 1. The infra-red transmitter 1402 is positioned in the lamp head 16 and is aimed downward, such that the transmitter 1402 and the receiver 1302 establish a beam path. When a user places her hand in the light exposure area 52 between the transmitter 1402 and the receiver 1302, thus breaking the infra-red beam, the sensor generates an electrical signal that is used, in turn, to activate the UV-LEDs 24. The positions of the transmitter 1402 and receiver 1302 shown here are exemplary and could be placed elsewhere in the light exposure area 52. Further, while one pair of active infra-red sensors are illustrated, more than one pair could be used for enhanced coverage and sensitivity. Still further, a passive IR sensor could be used in either the lamp head 16 or the base 12.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments disclosed.

What is claimed is:

1. A nail gel curing lamp comprising:

a base;

a lamp head mounted on and positioned above the base;

wherein the lamp head is operatively connectable to a power source and comprises at least one, but no more than three ultraviolet light emitting diodes ("UV LED") configured to direct light emitted by the UV LED generally toward the base, thereby defining a light exposure area extending from the UV LED downward toward the base;

wherein an arc of access to the light exposure area is defined as an arc in a horizontal plane between the lamp head and the base, wherein the base, and the lamp head are configured to allow unimpeded access of a user's hand to the light exposure area throughout the arc of access;

wherein the arc of access is at least 180 degrees;

wherein a height of access to the light exposure area is defined as the height from the UV LED to the base; and wherein the height of access is between 35 mm and 65 mm.

2. The nail gel curing lamp of claim 1 further comprising:

an activation mechanism located on the base, wherein the activation mechanism is operably connected to the UV LED, such that the user may activate the UV LED when the user's hand is within the light exposure area.

3. The nail gel curing lamp of claim 1 wherein the activation mechanism comprises a mechanical button switch positioned on the base within the light exposure area.

4. The nail gel curing lamp of claim 1 wherein the activation mechanism comprises a touch switch.

5. The nail gel curing lamp of claim 4 wherein the touch switch comprises a capacitance switch.

6. The nail gel curing lamp of claim 4 wherein the touch switch comprises a resistance switch.

7. The nail gel curing lamp of claim 4 wherein the touch switch comprises a piezo touch switch.

8. The nail gel curing lamp of claim 2 wherein the activation mechanism comprises a motion sensor.

9. The nail gel curing lamp of claim 8 wherein the activation mechanism comprises a passive infra-red sensor.

10. The nail gel curing lamp of claim 8 wherein the activation mechanism comprises an active infra-red sensor.

11. The nail gel curing lamp of claim 1 comprising:

wherein the activation mechanism comprises an infra-red transmitter and an infra-red receiver;

wherein the infra-red transmitter is positioned in the lamp head and aimed downwardly;

wherein the infra-red receiver is positioned in the base such that it is generally aligned with the infra-red transmitter;

wherein when the infra-red transmitter is transmitting, a beam path is created between the transmitter and receiver; and wherein the presence of an obstruction in the beam path will close an activation circuit that activates the UV-LED.

12. The nail gel curing lamp of claim 1 wherein the arc of access is equal to or greater than 270 degrees.

13. The nail gel curing lamp of claim 1 wherein the lamp head comprises two UV LEDs.

14. The nail gel curing lamp of claim 1 wherein the lamp is no more than 66 mm tall.

15. The nail gel curing lamp of claim 1 wherein lamp head further comprises recessed apertures for each of the UV LEDs, whereby the light emitted by each of the UV LEDs is further directed downwardly and lateral light exposure from the UV LEDs is limited.

16. The nail gel curing lamp of claim 1 wherein the lamp has a height of about 66 mm, a width of about 47 mm, a depth of about 58 mm, a height of access of about 40 mm, and a depth of access of about 43 mm.

* * * * *